United States Patent [19]

Yaworsky

[11] 4,319,754

[45] Mar. 16, 1982

[54] WARFARE SIMULATING GAME APPARATUS

[76] Inventor: James J. Yaworsky, R.R. #1 Inglewood, Ontario, Canada, L0N 1K0

[21] Appl. No.: 159,129

[22] Filed: Jun. 13, 1980

[51] Int. Cl.[3] ..... A63F 3/00

[52] U.S. Cl. ..... 273/241; 273/265; 273/282; 273/284; 273/287; 273/290

[58] Field of Search ..... 273/262, 265, 241, 281, 273/282, 287

[56] References Cited

U.S. PATENT DOCUMENTS

| | | | |
|---|---|---|---|
| 1,315,483 | 9/1919 | Edwards | 273/262 |
| 1,942,291 | 1/1934 | Jefferson | 273/241 |
| 2,794,641 | 6/1957 | Baker | 273/265 |
| 3,104,878 | 9/1963 | Roger | 273/265 |
| 4,232,864 | 11/1980 | Yaworsky | 273/241 |

FOREIGN PATENT DOCUMENTS

| | | | |
|---|---|---|---|
| 635614 | 9/1936 | Fed. Rep. of Germany | 273/265 |
| 1487327 | 1/1967 | France | 273/265 |

*Primary Examiner*—Richard C. Pinkham
*Assistant Examiner*—Carl Moy

[57] ABSTRACT

The specification of the present invention discloses a game board apparatus which allows two parties to efficiently play numerous games in which both parties move simultaneously and the observation of the opponent's playing surface is limited. The apparatus includes two parallel upright members with a removable shield disposed between these members. Blocking means are also provided for each upright member to selectively limit the observable area of the opposite upright portion when the shield is removed. According to an aspect of the invention, specialized playing pieces are provided which co-operate with said blocking and are engagable with the upright members such that a portion of the playing piece is visible when the blocking means is closed, thus simplifying the recordal of game data.

12 Claims, 13 Drawing Figures

WARFARE SIMULATING GAME APPARATUS

FIELD OF THE INVENTION

This invention relates to game board apparatus of the type having two playing board surfaces and a removable shield disposed between the boards. The game apparatus is primarily designed for use by two players who sit directly opposite one another with the game structure positioned between them.

BACKGROUND OF THE INVENTION

Various game board structures have been proposed to simulate actual confrontations between parties to provide a more realistic game. This has been accomplished by allowing simultaneous movement by each player without observation by his opponent thereby, introducing the additional uncertainty that the exact location of the opponent is not known and increasing the total number of possible outcomes.

One structure showing such simultaneous movement is disclosed in U.S. Pat. No. 2,794,641 which issued to Baker et al, June 4, 1957. This structure has a removable shield member disposed between two upright board members with a number of apertures for locating playing pieces. The structure also allows the game environment to be changed by inserting sheets within the shield member to add a further variant to the game conditions.

My copending U.S. patent application Ser. No. 358 filed Jan. 2, 1979, now U.S. Pat. No. 4,232,864, also allows simultaneous movement by a number of players by providing a structure which uses a number of playing boards which are slidably received within a structure such that the boards may be superimposed and the resulting combination observed from above. The structure includes a viewing means located above the superimposed playing boards which has a number of columns which may be opened or closed to restrict the viewable area. Although this structure is very useful for three or more players, it is awkward and time consuming when only two players are playing, as they each must take turns using the viewer which must be adjusted for each player. The Baker et al patent, although it allows simultaneous movement by each player, suffers in that the game conditions are set by the sheets placed in the removable shield which are known to the players before the start of the game and in that once the shield is removed, the opponent's total playing surface is revealed.

According to the present invention, a game apparatus is provided which is simple in structure and easy to operate while providing the advantages of simultaneous movement and limited observation, according to the location of playing pieces. Furthermore, according to an aspect of the invention, the game conditions can be set by one or both of the players before the commencement of the game, thereby giving the total freedom in the layout of the game conditions and increasing the uncertainty regarding the game conditions as all game conditions may not be known to each player at the start of the game and must be uncovered as the game progresses.

SUMMARY OF THE INVENTION

The apparatus according to the present invention comprises two upright board members, spaced apart from one another, a removable shield disposed in the space between the board members with the board members including means for receiving the playing pieces.

Blocking means is also provided for selectively covering portions of the upright members and the structure is such that the removable shield isolates the upright members from each other to allow placement of playing pieces without observation. The blocking means limits the extent of observation of the opposite board member to the portions essentially directed opposite the uncovered areas of the board when the shield is removed.

According to an aspect of the invention, the upright board members are webs which have a plurality of openings for receiving playing pieces. Of these playing pieces there are game condition pieces which are receivable within the openings of the web members and include a projecting portion which is visible when the associated blocking means of that aperture is closed. This provides a simple method to allow the player to record the game condition pieces he has placed on his game board prior to the commencement of the game and to also mark game condition pieces that he has observed. The projecting portion of each of these playing pieces assure that the location and type of these pieces is known even with the blocking means closed.

According to a further aspect of the invention, the game apparatus is provided with hinged flaps secured to the web members to form the blocking means associated with the apertures of the webs.

According to a further aspect of the invention the openings of the web members are hexagonal and include the key portions on the sides of the openings for receiving various types of playing pieces with these keys being shaped such that game condition pieces are placed in one portion of the hexagonal opening and a second type of playing piece is placed within another portion of the aperture with a portion of the hexagonal opening remaining clear to allow observation of playing pieces secured to the opposite web.

BRIEF DESCRIPTION OF THE DRAWINGS

Preferred embodiments of the invention are shown in the drawings wherein.

DETAILED DESCRIPTION ACCORDING TO THE PREFERRED EMBODIMENTS OF THE PRESENT INVENTION

Figure 1:
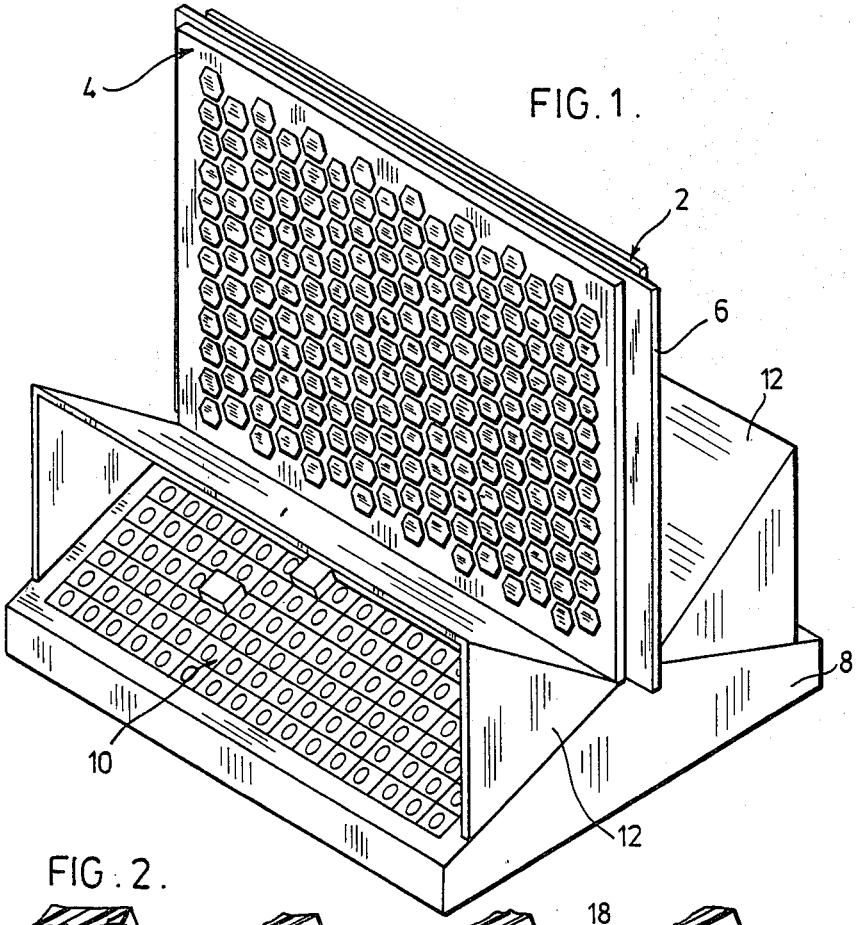
FIG. 1 is a perspective view of the game apparatus.

The game apparatus shown in FIG. 1 uses two upright board members 2 and 4, with a sliding, shielding member 6 disposed between the upright board members which are held in position by the base member 8. To either side of the upright board members is a counting surface 10 for recordal of game data with an associated screen member 12, rendering the counting surface observable from one side of the upright members only. Although the upright members can be adapted in several ways for receiving playing pieces of the game, it is preferred that they be formed of a hexagonal web member as shown in FIG. 1 with each hexagonal aperture adapted to receive at least two playing pieces.

Figure 2:
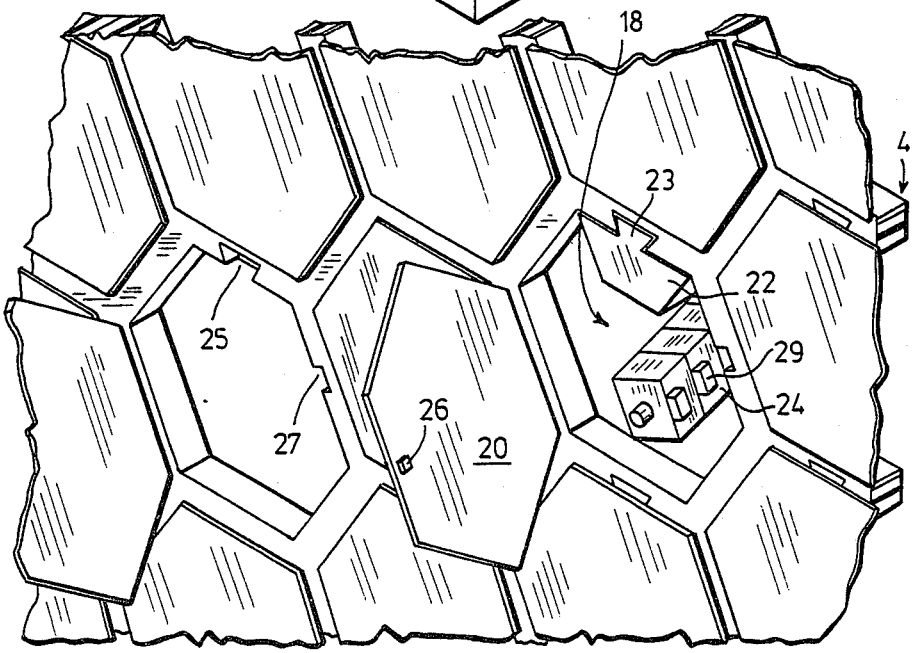
FIG. 2 is a partial enlargement of one of the upright members of the game apparatus.

A closeup view of a portion of the web member 4 is shown in FIG. 2 with hexagonal opening 18 having a game condition playing piece 22 and game men playing pieces 24 secured within the opening. Also associated with this hexagonal opening is the hinged flap 20 which forms a blocking means allowing the hexagonal aperture to be selectively either opened or closed.

Game condition piece 22 has a projecting key portion 23 which may be located within the recess 25 provided in each hexagonal opening. Each playing piece 22 has the same key portion thus assuring all game condition playing pieces are located on the same side of each hexagonal opening. Similarly, the game men playing pieces have a projecting portion 29 which is adapted to fit in the recess 27 of each hexagonal opening, thus assuring these playing pieces are located on a common side of each hexagonal opening. As can be seen in FIG. 2, a number of the apertures are in the open position and a number have also been placed in the closed position, so that it is not possible to view through the associated hexagonal apertures.

Figure 3:
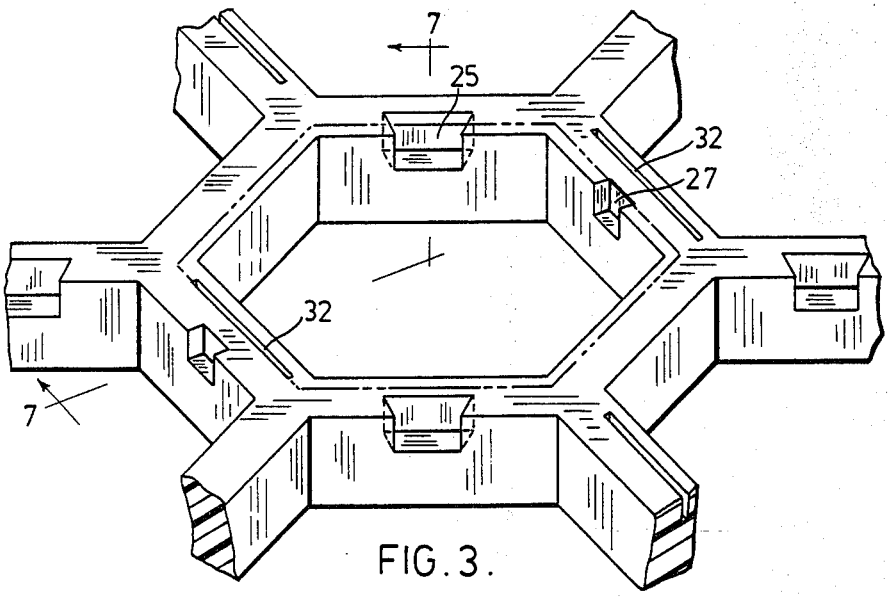
FIG. 3 is a perspective view of one of the hexagonal openings shown in FIG. 1.
Figure 4:
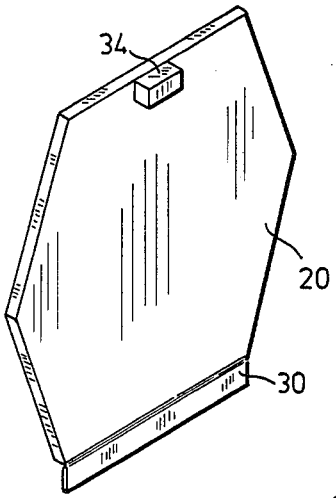
FIG. 4 is a perspective view of a hinged flap.
Figure 5:
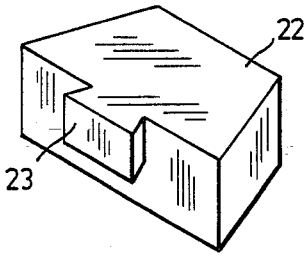
FIG. 5 is a perspective view of a game playing piece.
Figure 6:
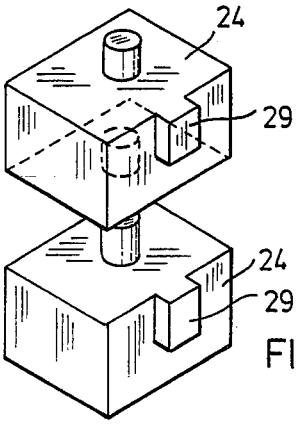
FIG. 6 is a perspective view of a second type of playing piece.
Figure 7:
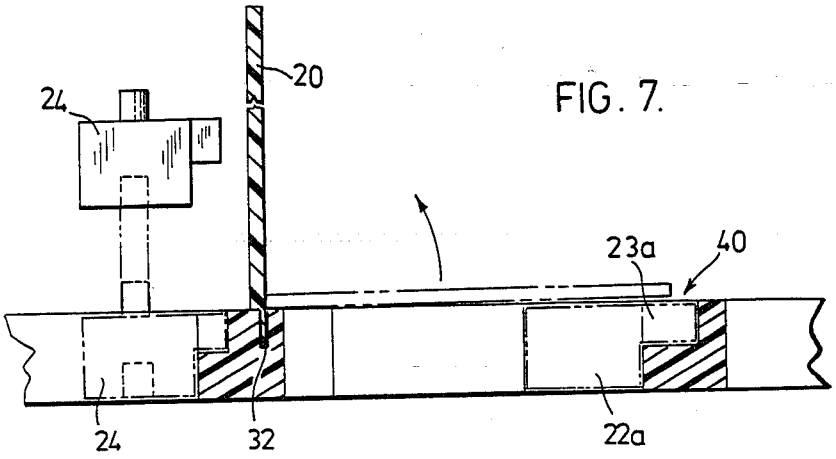
FIG. 7 is a partial section of one playing surface.

Further details on the keying of the playing pieces are shown in FIGS. 3, 5 and 6 and the particular relationship of the hinged flap 20, and hexagonal opening can be appreciated with respect to FIGS. 3, 4 and 7. As can be seen in FIG. 5, the projecting portion 23 of the game condition playing piece 22 does not extend over the entire height of the playing piece nor does the recess 25 extend through the depth of the web member. Furthermore, the projecting portion 23 when positioned within an hexagonal opening, extends into the side of the opening a sufficient distance such that the associated flap does not fully cover the playing piece and a portion of this projecting member is still visible. This aspect is more clearly shown in FIG. 7 where the terrain game condition piece 22A is positioned within an hexagonal opening and a portion 40 of the projecting portion 23A can still be observed when the flap member is in the closed position.

Each flap member 21 can be made of a suitable plastic material such as polypropylene and have a thinned hinge member 20 secured to one side of the flap. This hinge portion is inserted within slot 32 associated with each hexagonal aperture to provide a simple method for securing the flap to the upright board members and to allow closure of the flap. It is also possible to position to slot 32 relative to the key portion 29 such that when the flap is moved to the closed position, the projecting portion 34 provided on the hinge, engages this keyed portion and holds the flap in the closed position. By providing the hinged portion 30 of slightly smaller thicknesses, than the flap 20, the additional thickness of the flap abuts with the web members and maintains the flap at approximately 90° to the web member in the open position. It can readily be appreciated that this particular system is quite simple to produce but other methods are also possible for providing a hinged flap which may be biased to one position and includes means for maintaining it in the other position. It is also possible to use unbiased hinged flaps which can be secured to a generally vertical segment of the web and is thereby not urged by gravity to either the open or closed position. Other structures such as caps could also be used to selectively block portions of the upright board members.

Figure 8:
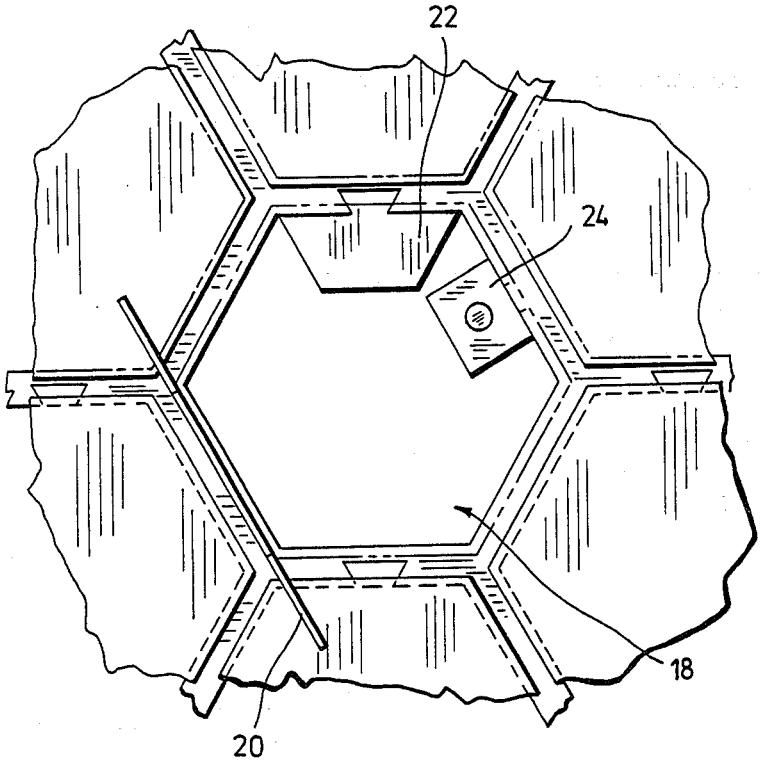
FIG. 8 is a partial front section of one of the playing surfaces.
Figure 12:
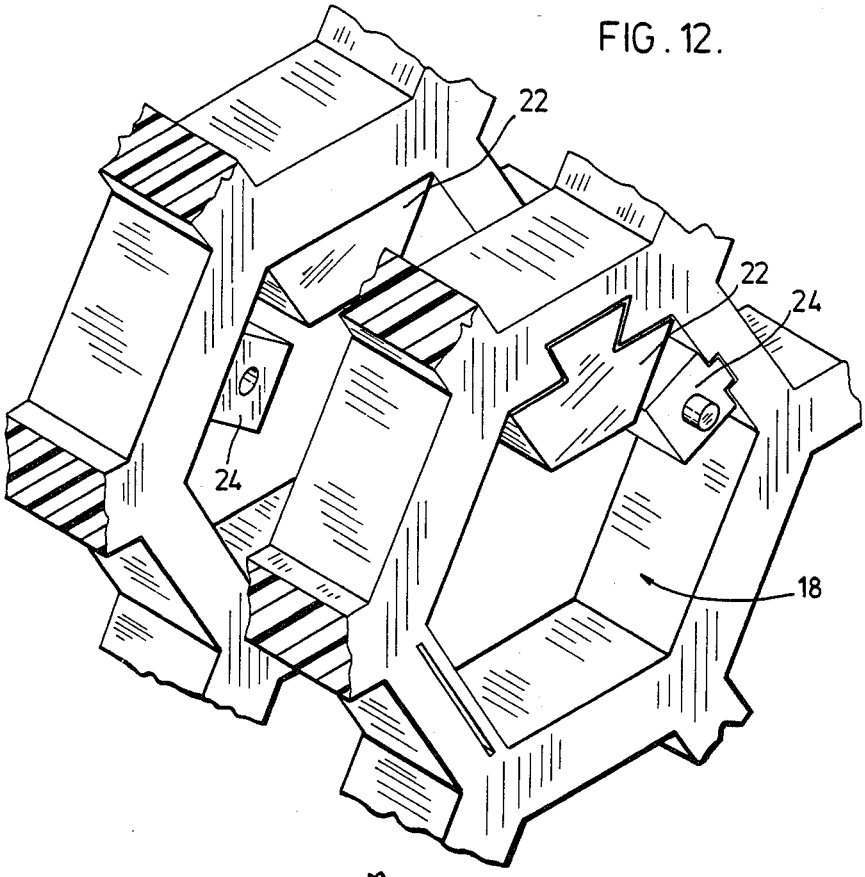
FIG. 12 is a partial perspective view showing the relationship of opposite upright members and the interaction of the playing pieces.

As can be seen in FIG. 8, game condition playing piece 22 is secured within one of the hexagonal openings as well as game playing man 24, and a large portion of the hexagonal aperture remains open. This open portion of the space allows the player to look through the aperture and identify whether any playing pieces are in the directly opposite hexagonal of his opponent. When the web members are each identical, the orientation of the board is moved through 180° such that the game condition playing pieces are still located to the other side of the game condition playing piece. This is very advantageous as the opponent's playing piece will now be positioned within an open portion of the aperture allowing a player to observe its presence if the hinged flap is open. It will also allow the player to uncover any game condition playing pieces which he was not previously aware of and mark his board accordingly. This aspect can be more fully appreciated with respect to FIG. 12 where two corresponding hexagonal apertures are shown, each having game condition playing pieces and the game men playing pieces.

As seen in FIG. 7, the game condition playing pieces are sized such that when inserted into one of the upright members, they are flush with the outer surface allowing the hinged flap to completely close the associated aperture even where a game condition playing piece is located within the aperture. This provision is not necessary with the game men playing pieces as a hinge flap is open when one of these playing pieces are located within the aperture. It is important for the game men playing pieces to stack such that several different types of men can be located within the same aperture allowing the separate pieces to be moved as a unit.

Figure 11:
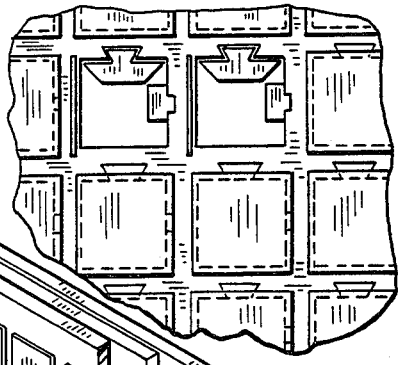
FIG. 11 is a partial front view of the rectangular upright member shown in FIG. 10.
Figure 10:
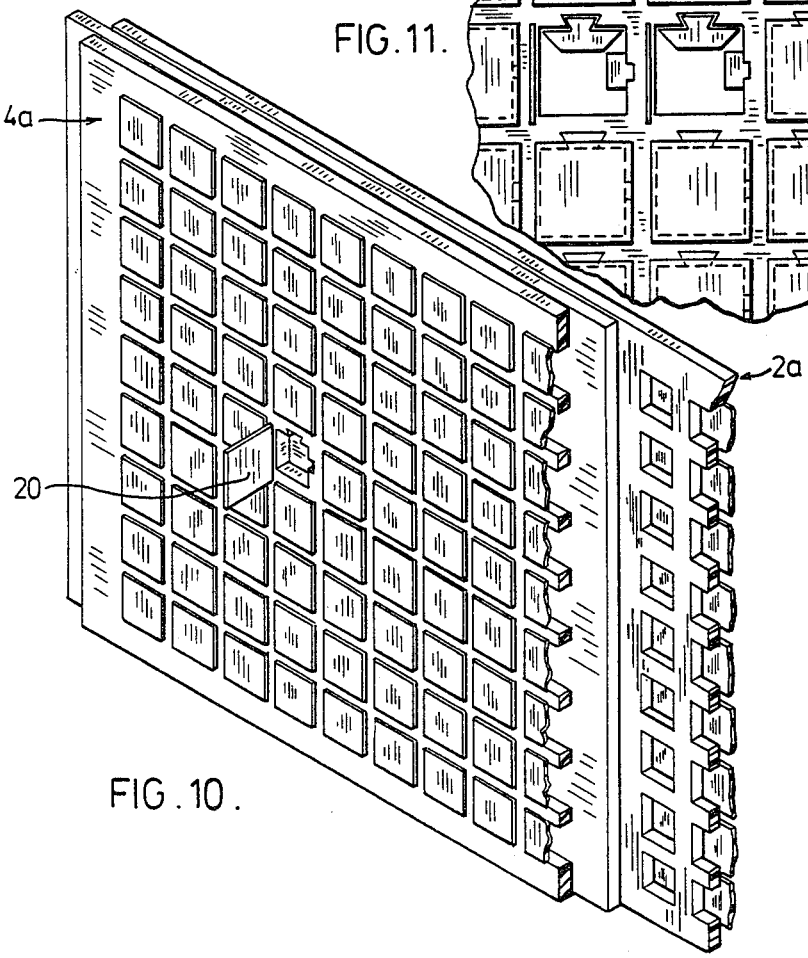
FIG. 10 is a partial perspective view of alternate upright members which could be used with a game apparatus.

With respect to FIGS. 10 and 11 the upright members 2A and 4A have been provided with a rectilinear grid network and hinged flaps provided with each aperture. As shown in the previous drawings, these apertures again have key portions which are such that the exact location of game condition playing pieces and game men playing pieces are determined by the network. Similarly, a portion of the game condition playing piece is visible when the hinge flap is closed. It can also be appreciated that other structures are possible for the upright members however, they must include a blocking means such that each designated area can be selectively opened and closed. It is also preferable that the upright members be such that each player can only locate his own game men pieces in specified areas which are not directly opposite his opponents, such that these playing pieces can be observed from either side of the upright members when the associated blocking means are open and the shielding member 6 is removed.

Figure 13:
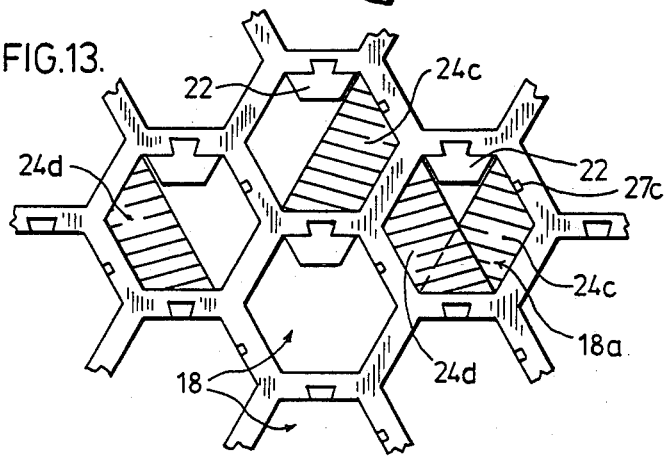
FIG. 13 is a partial front view of the upright members using playing pieces of an alternate construction.

An alternate type of game men playing piece 24C for one player and 24D for the other player is shown in FIG. 13. Each of these pieces essentially occupy half of the hexagonal opening 18 and can include a keyed portion 27C to position the playing piece. As can be seen in aperture 18A three playing pieces can be observed, 24C, 22 and 24D. Playing piece 24D is located in the opposite upright member whereas, pieces 22 and 24C are in the front upright member. The keyed portion 29C may be provided to assure all pieces are visible due to positive location, and playing pieces 24C and 24D only partially overlap. It can be appreciated that by using similar upright members, the playing pieces will be located as shown and a large area of each playing piece is visible. Furthermore, this particular shape playing accurately locates within the hexagonal openings of the upright members and are convenient to handle due to their increased size.

Figure 9:
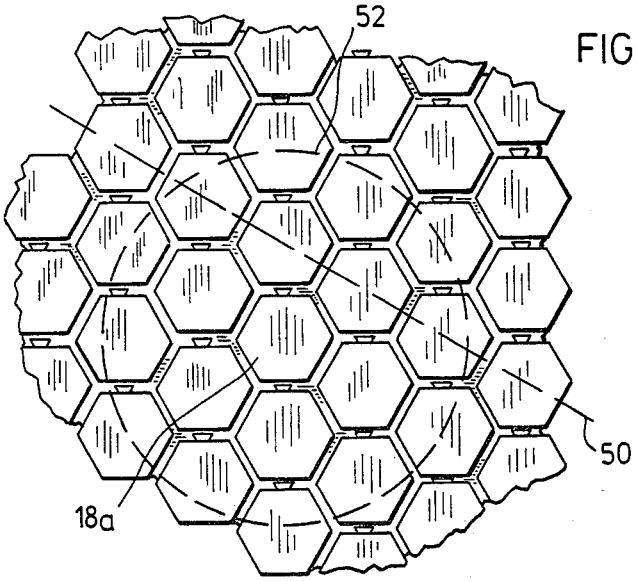
FIG. 9 is a front view of one of the playing surfaces, in which the line of vision of a playing piece is shown.

With respect to FIG. 9, if a man is located within aperture 18A then the rules of the game would allow him observation of several associated apertures and this area of vision has been roughly approximated by the circle 52. If no game condition playing pieces are encountered, all apertures within circle 52 would have the associated blocking means open and the entire area of the circle would define a window through which the player could observe his opponent's playing board. However, if certain game condition playing pieces are located along line 50, and these playing pieces represent terrain such as a hill or mountain range, then the apertures beyond this line would not be visible and the flaps would have to remain closed. In order to accomplish this, the players normally position their playing pieces with the shielding member disposed between the upright members such that observation of the location of their playing pieces can not be made by their opponent. After completing their move, any flaps which can no longer remain open are closed and then the shielding member removed. After the shielding member is removed, the flaps which the player normally has a right to, are opened unless a game condition playing piece is encountered.

Therefore, the combination of this sliding, shielding, member and blocking means associated with each upright member, allows both simultaneous movement by each player and restricted observation which more realistically simulates actual conditions of life and particularly, actual conditions encountered in battles between opponents. Thus, this apparatus provides a simple structure which allows game playing pieces to be observed when blocking means are closed as well as providing a relatively simple structure which increases the uncertainty with which the player must conduct his moves and thereby provide a more challenging game.

Although preferred embodiments of the invention are described herein, in great detail, it will be understood by those skilled in the art, that variations may be made thereto, without departing from the spirit of the invention or the scope of the appended claims.

The embodiments of the invention in which an exclusive property or privilege is claimed are defined as follows:

1. A game board comprising two upright web members spaced apart from one another, a removable shield disposed in the space between said web members, said web members defining openings in which playing pieces may be received, and blocking means associated with the openings of each web for selective closure thereof, wherein said removable shield isolates said webs from each other to allow placement of playing pieces without observation through the upright members and said blocking means limits observation of the opposite web to the portions essentially directed opposite the uncovered openings of each web when said shield is removed and including game condition playing pieces receivable within the openings of said webs and including a projecting portion which is visible when said associated blocking means closes an opening of said web members.

2. A game apparatus as claimed in claim 1, including game men playing pieces receivable within the openings of a web independent of said game condition playing pieces.

3. A game apparatus as claimed in claim 1, or 2, wherein said blocking means includes hinged flaps sized to cover one opening of said web member.

4. A game apparatus as claimed in claim 1 wherein said blocking means includes flaps hinged to one of said webs and sized to cover at least one opening of said web members and including two types of playing pieces; the first type of playing piece being said game condition playing piece which allows closure of said hinged flaps and includes a projecting portion which is not covered by a closed flap; said second type of playing piece being insertable into an opening of said webs independent of said first type of playing piece and carrying colour indicia.

5. A game apparatus as claimed in claim 4 wherein the projecting portion of said first type of playing piece is received within a notch provided in one of the walls defining an opening of said web member and locates and holds said first type of playing piece in place, said second type of playing piece having a shape which engages the opening of said webs to locate and hold said second type of play piece, said playing pieces being sized and located with an opening such that a portion of such opening remains clear when both types of playing pieces are located therein to allow observation of a second type playing piece if located in the aligned opening of the opposite web.

6. A game apparatus as claimed in claim 5 wherein said second type of playing pieces are stackable.

7. A game apparatus as claimed in claim 5 wherein said second type of playing pieces include two groups of different colour indica wherein the colour indica of one group does not overlap with the colour indica of the other group when said pieces are aligned in opposite web members.

8. A game apparatus as claimed in claim 5 including at least two types of playing pieces engagable at different positions within the openings of said web, whereby both types of playing pieces when located in an opening, are visible from either side of said web and wherein a portion of the opening remains unobstructed allowing observation of the directly portion of the opposite web when said shield is removed.

9. A game apparatus as claimed in claim 8, wherein, one type of the playing pieces when located within the opening of the webs are positioned opposite the unobstructed portion of the opening of the opposite web when said shield is removed.

10. A game apparatus comprising two upright board members spaced apart from one another, a removable shield disposed in the space between said board members, said board members including means for receiving playing pieces and blocking means for selectively covering portions of said upright members, wherein said removable shield isolates said board from each other to allow placement of playing pieces without observation through the upright members and said blocking means limiting the extent of observation of the opposite board member to the portions essentially directly opposite the uncovered areas of said board members when said shield is removed and including playing pieces having a portion visible when located on an upright member and said block means is positioned to cover the playing piece.

11. A game apparatus as claimed in claim 10 wherein said blocking means includes hinged flaps and said upright members are essentially transparent.

12. A game apparatus as claimed in claim 11, including at least two types of playing engagable at different positions on said upright members, whereby both types of playing pieces when positioned on said upright members are visible from either side of the upright members and wherein one type of playing piece when located in generally opposite portions of the upright member are both visible through either upright member when said shield is removed.

* * * * *